US006389980B1

(12) United States Patent
Croses et al.

(10) Patent No.: US 6,389,980 B1
(45) Date of Patent: May 21, 2002

(54) CHAIR LIFT WITH IMPROVED BOARDING

(75) Inventors: Alain Croses, Cagnes sur Mer; Alain Beaumin, Tignes, both of (FR)

(73) Assignee: Etudes de Transports S.A.R.L., Modane (FR)

( * ) Notice: Subject to any disclaimer, the term of this patent is extended or adjusted under 35 U.S.C. 154(b) by 0 days.

(21) Appl. No.: 09/720,899

(22) PCT Filed: Jul. 1, 1998

(86) PCT No.: PCT/FR98/01402

§ 371 Date: Jan. 2, 2001

§ 102(e) Date: Jan. 2, 2001

(87) PCT Pub. No.: WO00/01566

PCT Pub. Date: Jan. 13, 2000

(51) Int. Cl.[7] ..... B61B 7/00
(52) U.S. Cl. ..... 104/28; 104/178
(58) Field of Search ..... 104/27, 28, 30, 104/173.2, 173.1, 178, 179, 184, 189

(56) References Cited

U.S. PATENT DOCUMENTS 430,180 A * 6/1890 Emery ..... 104/173.1
4,050,385 A * 9/1977 Gurr et al. ..... 104/28
4,958,574 A * 9/1990 Meindl ..... 104/88
5,626,078 A * 5/1997 Fuchs ..... 104/88

FOREIGN PATENT DOCUMENTS

FR 2 758 511 7/1998
WO WO96/29223 * 3/1996

* cited by examiner

*Primary Examiner*—Mark T. Le
(74) *Attorney, Agent, or Firm*—Young & Thompson

(57) ABSTRACT

A station for boarding a chairlift for continuously moving ropeway transport. The chairlift includes several seats, either fixed or detachably coupled at regular intervals. Each seat is taken in turn by successive ramps, an arrival, a turnaround and a departure ramp, the arrival and departure ramps being parallel. The turnaround ramp includes two turnings, upstream and downstream, separated by a rectilinear transfer ramp. A boarding site is located at an exit of the downstream turning. An angle α between the arrival and transfer ramps, corresponding to the upstream turning is acute. An angle between the transfer and departure ramps, corresponding to the downstream turning is obtuse. The drive elements cause each seat to pivot on itself at the transfer ramp.

17 Claims, 4 Drawing Sheets

CHAIR LIFT WITH IMPROVED BOARDING

BACKGROUND OF THE INVENTION

The present invention has for its object a chairlift that is improved as to its loading station. To do this, each seat, before arriving at the loading station, is oriented to facilitate loading.

The state of the art can be defined by the document FR 2.614.858, which proposes a process for telepherage of the family of chairlifts, using single place seats whose bucket seats are orientable relative to the suspension, whilst the bodyguard tubes remain fixed, thereby permitting facilitating loading and unloading of the passengers whilst ensuring the relative position of the bodyguard relative to the bucket seat for locking this latter when leaving the loading zone. An assembly of guides along the ground in collaboration with a roller, a lug, a sliding pivot, permits stabilizing the seats, oriented the bucket seats and locking the bucket seats.

This type of chairlift, in addition to the fact that it is used only for so-called fixed seats, is impossible to use for seats having more than two sitting locations. Thus, in the loading zone, each seat is presented laterally, which is to say that the back is positioned within the turn of the turnaround.

Moreover, the safety of such an installation is not optimum, the person before loading presenting his back to the seat and said seat moving substantially perpendicularly to the movement of said person who sits on it. There is a risk that this person will not find the seat. The securement of the bodyguard, which is not movable as the seat is, does not facilitate loading either.

Finally, from an economic point of view, the ground of the loading station must be arranged to receive guide means, such as rails, and the pivoting means for the seat must be able to blocked to gain movement of the seats between the departure and arrival stations.

FR 2.236.707: Chairlifts with non-detachable seats spaced along an aerial cable that continuously moves along a closed path, passing to the departure station through a loading emplacement for skiers, comprising an access track and a fixed track which converge with said movement path of the seats at an acute angle to said loading station to permit skiers upon leaving to face in the same direction as the seats that are inserted progressively into the intervals provided between successive seats.

This patent discloses a chairlift that can hardly be used. It is possible to have skiers walk in a straight line, but it is very delicate to have them turn and above all when there are six skiers in line, in this patent, there are described two 30° turns and the seat of the chairlift is itself always in a straight line.

EP 0 443 913: The loading zone in the vehicle moving slowly through a station is broken up by means of separator elements into corridors oriented according to the direction forming an acute angle $\alpha$ with the direction of advance of the vehicle. This arrangement promotes a predetermined boarding by the passengers and leads to an increase in the space required for the vehicles.

This patent discloses a loading dock which forms an S shaped path for the passengers before boarding.

FR 2.692.858: This cable transport installation, of which at least one is a driver and is driven at a constant speed according to a closed loop between two stations and carrying a plurality of vehicles ensuring the transportation properly so-called, comprises at the level of each station an arrival path provided with a device for slowing said vehicles to reduce their speed after uncoupling of the cable or cables, and a departure path provided with a starting device to bring the vehicles to the speed of the cable or cables when they are attached to the latter at the outlet of the station. Each station moreover comprises a linear transfer device for the cabin from the arrival path to the departure path, which transfer is perpendicular relative to the axis of said paths.

This patent discloses an installation with cabins. There are no passengers nor pivoting seats.

FR 1.393.778: The invention has for its object a mechanical raising installation for aerial transport, between a so-called lower station and a so-called upper station for skiers keeping their skis on the feet at least in the outward sense, characterized in that it comprises vehicles with lateral loading and discharging, continuously driven along a guide in the form of a closed loop and in which the skiers are carried with their skis disposed transversely relative to the path of the vehicles.

SUMMARY OF THE INVENTION

The present invention has for its object the increase of the flow rate of a chairlift by modifying the position of the seat in the region preceding loading.

This modification consists in a rotation of the seat from an angle which permits the front surface of the seat to approach a parallel to the waiting line of skiers.

This position reduces substantially the phenomenon of "sweeping" about the curves, which increases with the width of the seat.

To this end, according to a first embodiment, the present invention relates to a loading station for a chairlift for aerial cable transport that is continuously moving, the chairlift comprising several seats, with at least one place for each person, coupled to the cable and regularly spaced so as to be fixed or detachable, at the level of the loading station, relative to said cable, each seat being directed by successive ramps, called arrival, turnaround and departure, the arrival and departure ramps being parallel, the turnaround ramp comprises two turns, called upstream and downstream, separated by a rectilinear transfer ramp, that the line of skiers is in alignment with the departure ramp.

The loading station is characterized by the fact that a loading place is located at the outlet of the down-stream turn, that the angle ($\alpha$) between the arrival and transfer ramps, corresponding to the upstream turn, is acute and the angle ($\beta$) between the transfer and departure ramps, corresponding to the downstream turn, is obtuse.

According to a second embodiment, the drive elements cause each seat to pivot on itself at the level of the transfer ramp before coming alongside.

The drive elements cause the seat to rotate through an angle $\Phi$ which permits the front surface of the seat to approach a perpendicular to the line of waiting persons, this position of the seat reducing very substantially the phenomenon of "sweeping" about the curves, which increases with the width of the seat.

No matter what the embodiment, on the one hand, the angle $\alpha$ of the upstream turn is comprised between 35 and 55°, and, on the other hand, the angle $\beta$ of the downstream turn is comprised between 125 and 145°.

More precisely, on the one hand, the angle $\alpha$ of the upstream turn is 45°, and, on the other hand, the angle $\beta$ of the downstream turn is 135°.

According to the second embodiment, each seat is pivoted by 20 to 40°, the front surface of said seat orienting inwardly of the turn formed by the arrival, turning and departure ramps.

More precisely, each seat is pivoted by 30°, the front surface of said seat orienting toward the interior of the turn formed by the arrival, turnaround and departure ramps.

No matter what the embodiment, between the upstream and downstream turns, on the transfer ramp, the drive elements accelerate the seats.

The ratio between the speed of each seat at the level of the loading station and at the level of the transfer station is proportional to the angle α or β of the upstream or downstream turn.

This ratio is:

$$\frac{V\ \text{loading}}{V\ \text{transfer}} = \cos\alpha = \sin\beta$$

In the case in which the people who wish to board are directed by an endless belt, which moves them toward the embarkation station, the speed of the endless belt is substantially identical to the speed of the turning seats.

BRIEF DESCRIPTION OF THE DRAWINGS

The accompanying drawings are given by way of indicative but not limiting example. They show two embodiments according to the invention. They permit easy understanding of the invention.

DETAILED DESCRIPTION OF THE PREFERRED EMBODIMENTS

Figure 1:
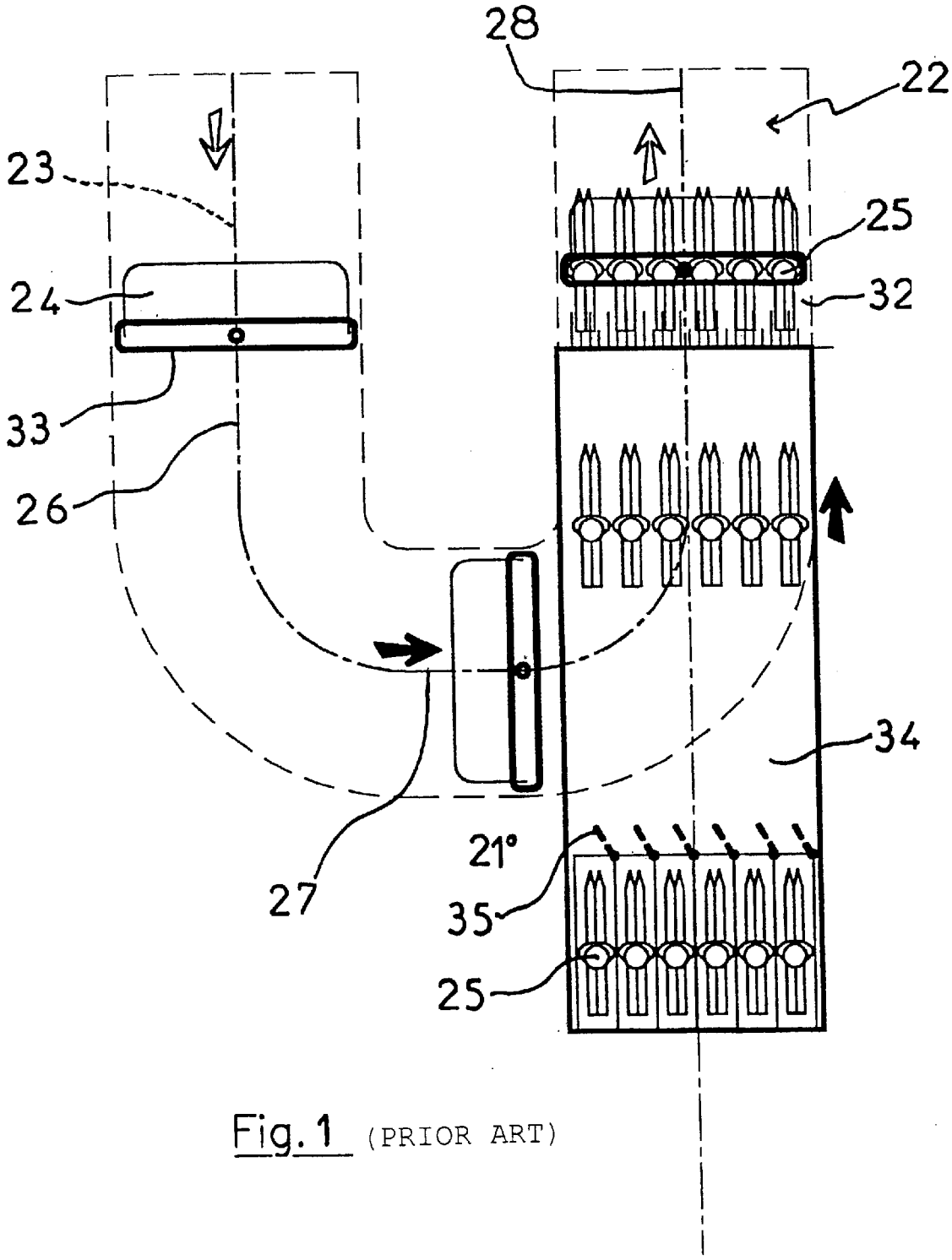
Fig. 1 (PRIOR ART)
FIG. 1 is a top plan view of the path of the seats in a conventional arrangement.

According to FIG. 1, the loading station 21 is of entirely conventional style. It comprises a chairlift 22 provided with an aerial cable 23, on which are secured detachably seats 24 permitting the transfer of persons or skiers 25.

The arrows permit distinguishing the direction of movement of said seats 24.

First of all, there is an arrival ramp 26, then a turnaround ramp 27 and finally a departure ramp 28.

The seats 24 from the unloading station, not shown in the figures, reach the arrival ramp 26 whilst the departure ramp 28 permits the seats 24 to be oriented in the direction of this unloading station, generally located at a height.

Again in an altogether conventional way, there is, at the end of the turnaround ramp 27, a loading station 32, on which skiers 25 take their place to be taken on by the seats 24. These latter 25 are brought to the level of this station 32 by means of an endless belt 34.

It will be noted that the front surface 33 of each seat 24 has a movement which exactly follows the path which is defined by the aerial cable 23.

In this FIG. 1, it will be seen that the sweep of the seat 24 permits only the delayed opening of the gates 35. The skiers are taken on by the seat 24 before the loading station 32, and the innermost skier 25 in the line will be seated prematurely at a place which is not his.

Figure 2:
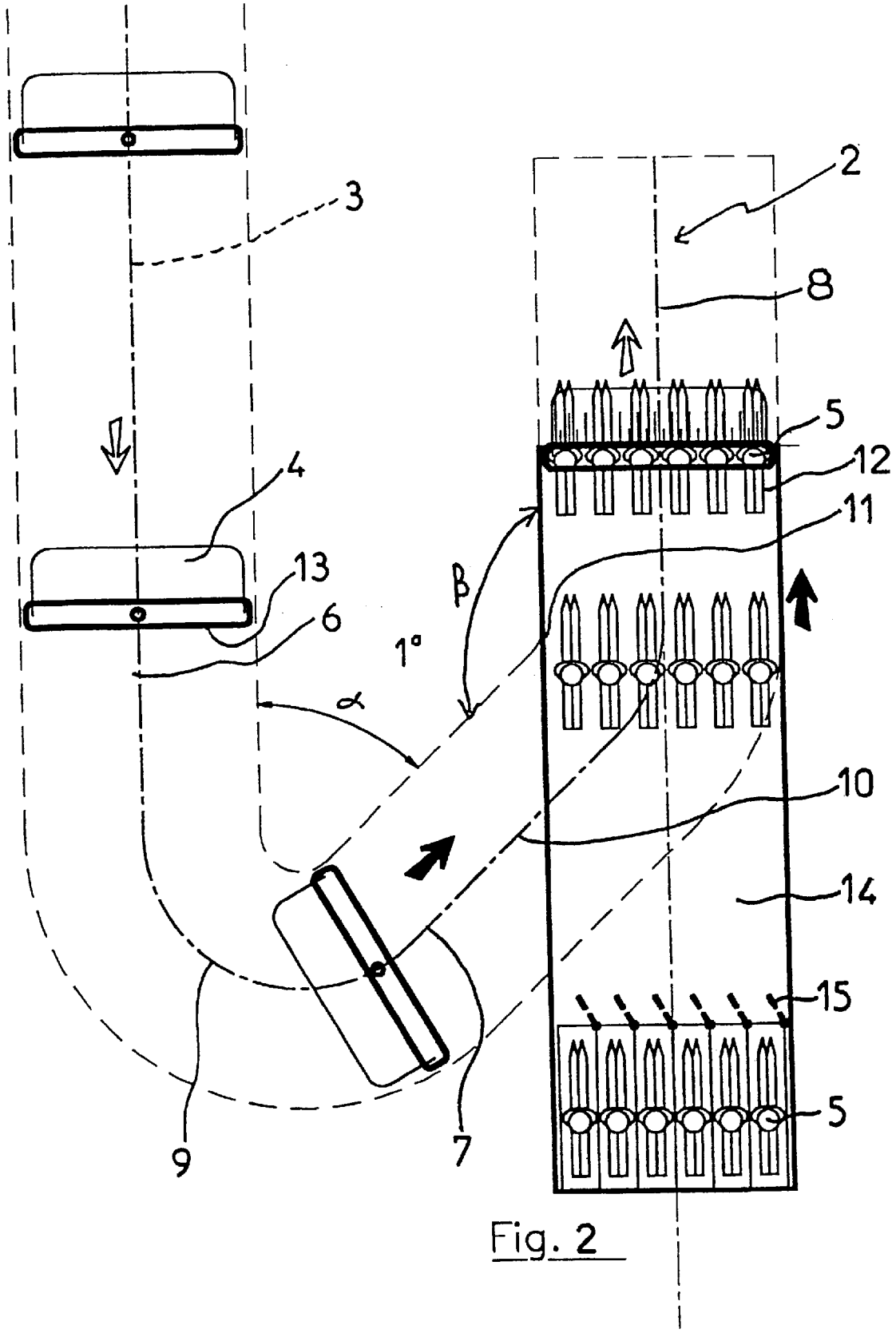
FIG. 2 is a top plan view of the path of the seats in an arrangement according to a first embodiment of the invention when the seat is at the level of the upstream turn.
Figure 3:
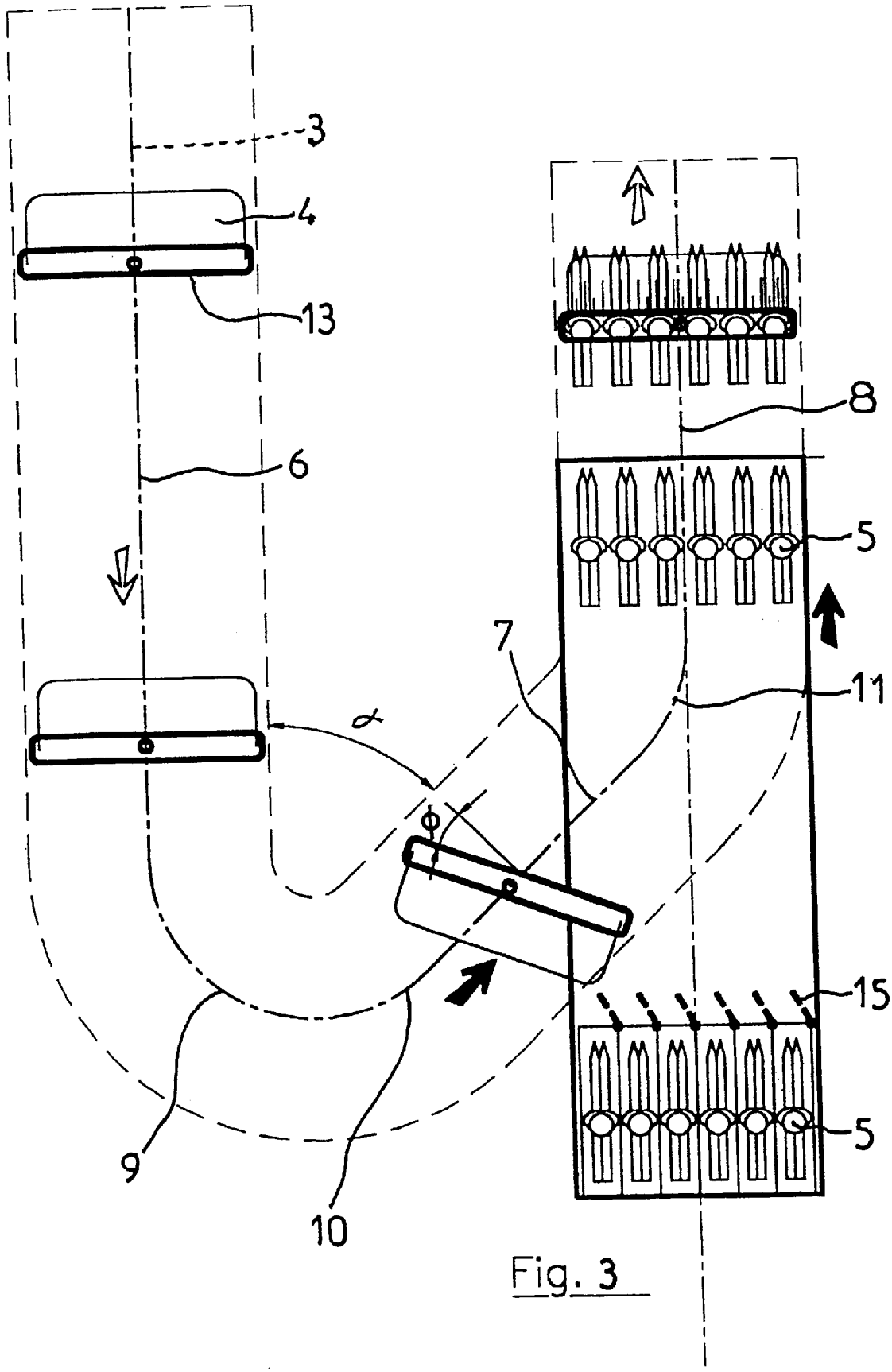
FIG. 3 is a view identical to FIG. 2, when the seat is at the level of the transfer ramp.

In FIGS. 2 and 3, a first embodiment of the present invention is shown. There is a loading station 1 of a chairlift 2, which comprises aerial cable 3. This aerial cable 3 comprises at regular intervals seats 4 which are detachable. Each seat 4 permits the boarding of a certain number of skiers 5 which are six in number in these figures, this number being non-limiting but representing a particularly interesting embodiment.

In an altogether conventional manner, there is thus an arrival ramp 6, on which the seats 4 are slowed to pass from a speed which is equivalent to the speed of movement, to a speed which is substantially 1.2 meters per second (m/s). In this case, the distance between two adjacent seats 4 is 6.48 m=δ.

The duration between the passage of a first seat 4 and the following seat is 5.4 s.

Then comes the turnaround ramp 7 whose particular structure will be described hereinafter.

Finally, the turnaround ramp 7 leads to the departure ramp 8 which is an acceleration ramp permitting the engagement of the grippers of each seat 4 and the return to full speed of each seat 4 to resume the speed of movement of the aerial cable 3.

The invention resides entirely in the shape of this turnaround ramp 7, there are two turns, an upstream one 9, the other a downstream one 11, separated from each other by a transfer ramp 10.

The interest of this invention resides in the fact that the two turns, upstream 9 and downstream 11, are not at the same level. They are offset such that the transfer ramp 10 is in a transverse position and not as is conventional perpendicular to the direction of movement of the seats 4.

In this position, there is thus an angle α between the arrival ramp 6 and the transfer ramp 10, and an angle β between this same transfer ramp 10 and the departure ramp 8.

According to the example shown in FIGS. 2 and 3, the angle α of the upstream turn 9 in a horizontal projection of the path preceding loading, is 45°. At the level of the downstream turn 11, the angle β is thus 135°, α+β corresponding to 180°.

In FIG. 2, the seat 4 thus has an entirely normal position.

In FIG. 3, the seat 4 has undergone a rotation of 30°, which places the front surface 13 at 15° relative to the line of waiting skiers 5.

Thus, the angle of 30° corresponds to the angle Φ between the longitudinal axis of the seat 4 and the perpendicular to the transfer ramp 10, which is to say to the longitudinal axis of said seat 4 not having turned.

It is thus evident that the arrival ramp 6 and the departure ramp 8 will be parallel.

After opening the gates 15, the skiers 5 are directed by an endless belt 14 which travels at constant speed, of the order of 1 m/s, which is identical to the speed of each seat 4, at the level of the loading station 12 but also at the level of the upstream and downstream turns 9 and 11.

In this arrangement, it is evident that the sweeping of the external end of the seat 4 is substantially nonexistent and that the loading of the skiers 5 on the same seat 4 is substantially simultaneous.

Moreover, at the level of the transfer ramp 10, the speed can be 1.4 m/s, the speed being relative to the angle α or the angle β.

Thus:

$$1.4 \times \cos 45° = 0.99, \text{ and}$$

$$1.4 \times \sin 135° = 0.99,$$

namely about 1 m/s, which corresponds to the speed of movement of the belt 14, and hence to the speed of arrival of the skiers 5 at the level of the loading station 12.

This speed increase permits, for an identical interval of time, which is to say 5.4 s, to increase substantially the distance between two seats 4 which is thus of $\gamma$=7.56 meters.

The two essential advantages of these two devices, are that, on the one hand, the rotation of the seat 4, for tangentially coming alongside that limits the sweeping phenomenon, and permitting rapid opening of the gates 15 after the passage of said seat 4 preceding the skiers 5.

On the other hand, the increase of the distance between two adjacent seats 4, renders more certain and comfortable the approach phase for the skiers 5 toward the loading station 12.

The invention fits into the volume of a so-called standard station. The only modifications relate to the variation of speed in the pre-loading phase and the emplacement of a device permitting rotation of the seat before and after loading. This device can be made from the suspension of the seat, from the gripper or from a system of parallel drive. This invention is particularly adapted to detachable installations with six seats, but it can also be applied to installations with a fixed gripper and no matter what the capacity of the seats.

According to FIG. 2, the row of skiers is stopped at the downstream end of the conveyor belt 14 ready to be loaded onto the seat 4. At this position, the speed of the seat 4 has been brought to 1 m/s.

A second row of skiers 5 is located behind the seat 4 on the conveyor belt 14 whose speed is also 1 m/s. The third row of skiers 5 approaches the closed gates 15.

In FIG. 3, the first row of skiers 5 is loaded on the seat 4 which is under control of the launcher. The second row is ready to leave the belt 14 and to take its place on the loading station 12. The second seat 4 is thus ready to pass before the gates which will open when the seat 4 faces the second gate 15.

Figure 4:
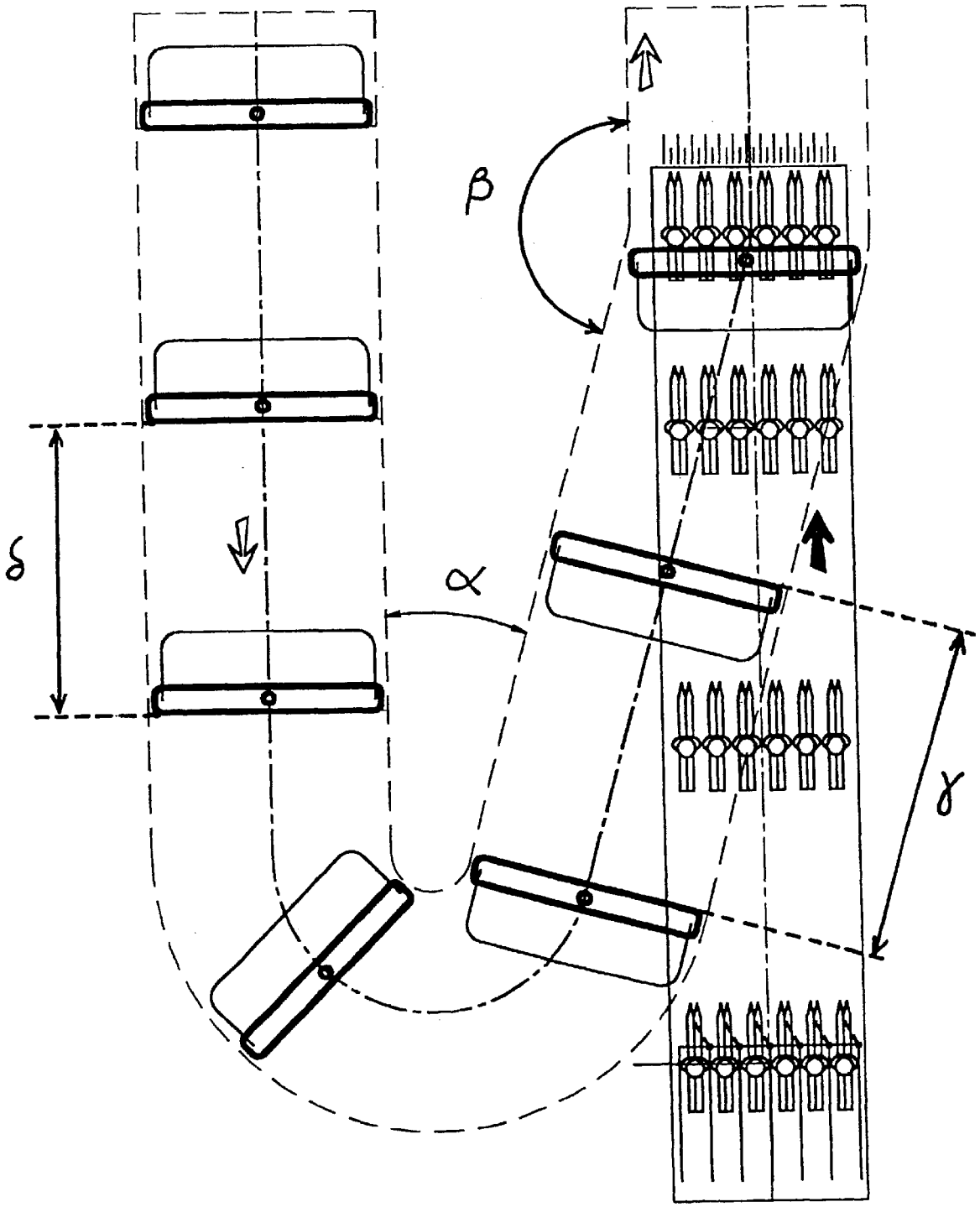
FIG. 4 is a top plan view of the movement of the seats in an arrangement according to a second embodiment of the invention.

In FIG. 4, the tangential coming alongside takes place at an angle of 15°, the angles $\alpha$ and $\beta$ being respectively 15° and 165°.

The same result can be obtained, according to FIG. 4, without pivoting the seat and by inclining the preceding loading path by 15°. This would increase in the rolling and pulling of the seats. The length of the pre-loading zone between the gate and the loading would then also be greatly increased, which gave rise to great difficulty in control of boarding.

In this embodiment, there is no rotation of the seat 4. The length of the contour and the length of the belt are much greater, from which results a not negligible increase in cost.

Moreover, three rows of skiers 5 are located simultaneously on the belt, which results in loading being very complicated or even impossible.

What is claimed is:

1. A combination of a chairlift and a loading station of the chairlift, the chairlift being connected to a continuously moving aerial cable and comprising:

a plurality of seats detachably coupled to the continuously moving cable, each of the plurality of seats having at least one seating place for at least one user, and being regularly spaced relative to the continuously moving cable, each of the plurality of seats, in an operative mode following a succession of ramps, said succession of ramps having, an arrival ramp, said plurality of seats having a first direction of movement when said plurality of seats are at said arrival ramp, a turnaround ramp having first and second turns, said first turn having a first end being at a first end of the arrival ramp, a rectilinear transfer ramp being between a second end of the first turn and a first end of the second turn, and a departure ramp being parallel to said arrival ramp and facing a second direction opposite said first direction, said second direction being co-linear with a loading direction of said at least one user, wherein said loading station is at a second end of the second turn, and an angle $\alpha$ between the arrival ramp and the transfer ramp is acute and an angle $\beta$ between the transfer ramp and the departure ramp is obtuse, a front surface of each of said plurality of seats forming an acute angle $\theta$ with said departure ramp when said front surface is adjacent said departure ramp.

2. The combination according to claim 1 further comprising a rotation device for pivoting each of said plurality of seats when each of said plurality of seats is at the transfer ramp, relative to the continuously moving aerial cable.

3. The combination according to claim 2 wherein the rotation device pivots through an angle so that the front surface of each of the plurality of seats when said front surface approaches a parallel to a line of waiting skiers, to reduce "sweeping".

4. The combination according to claim 2, wherein each of the plurality of seats pivots by 20–40°, the front surface of each of the plurality of seats being oriented toward an interior of the first and second turns.

5. The combination according to claim 2, wherein each of the plurality of seats pivots by 30°, the front surface of each of the plurality of seats being oriented inwardly of the first and second turns.

6. The combination according to claim 1 wherein the angle $\alpha$ is between 35 and 55°, and an angle $\beta$ 125 and 145°.

7. The combination according to claim 1 wherein the angle $\alpha$ is 45°, and the angle $\beta$ 135°.

8. The combination according to claim 1, further comprising drive elements for driving the chairlift and accelerating the plurality of seats between the first and second turns.

9. The combination according to claim 8, wherein a ratio between a speed of each of the plurality of seats at the loading station and at the transfer ramp is proportional to at least one of the angles $\alpha$ and $\beta$.

10. The combination according to claim 9, wherein the ratio is:

$$\frac{V \text{ loading}}{V \text{ transfer}} = \cos\alpha = \sin\beta.$$

11. The combination according to claim 9 further comprising an endless belt for transporting a line of waiting skiers to the loading station, a speed of the endless belt being substantially the same as to a speed of each of the plurality of seats in the first and second turns.

12. A combination of a chairlift and a loading station of the chairlift, the chairlift being connected to a continuously moving aerial cable and comprising:

a plurality of seats detachably connected to the continuously moving aerial cable;

a loading station for loading at least one user on to one of the plurality of seats; and means for positioning the plurality of seats relative to the at least one user, before the plurality of seats reaches the loading station when the chairlift is in operation.

13. The combination as claimed in claim 12, further comprising a rotation means for rotating each of the plurality of seats relative to the continuously moving aerial cable.

14. A combination of a chairlift and a loading station of the chair lift, the chairlift being connected to a continuously moving aerial cable and comprising:

a plurality of seats detachably connected to the continuously moving aerial cable;

a loading station for loading at least one user on to one of the plurality of seats, the at least one user being loaded in a first direction; and a plurality of ramps in succession, the plurality of ramps comprising an arrival ramp, a direction of movement of the plurality of seats at the arrival ramp being opposite the first direction;

a turnaround ramp having only two turns, a first turn and a second turn, each of the plurality of seats turning through an obtuse angle when each of the plurality of seats are in the first turn, and each of the plurality of seats turning through an acute angle when each of the plurality of seats are in the second turn, so that the direction of movement of the plurality of seats is the same as the first direction when each of the plurality of seats has moved through the second turn;

a rectilinear transfer ramp between the first and second turns; and a departure ramp at the loading station so that when the at least one user is loaded onto said one of the plurality of seats, the at least one user remains in the first direction.

15. The combination as claimed in claim 14, further comprising a rotation device for pivoting each of the plurality of seat relative to the continuously moving aerial cable.

16. The combination as claimed in claim 15, wherein each the seats pivots by between 20 and 40 degrees.

17. The combination as claimed in claim 14, further comprising at least one drive element for moving the chairlift, the at least one drive element accelerating each of the plurality of seats between the first and second turns.

* * * * *